United States Patent [19]

Yasnitsky et al.

[11] 4,347,057

[45] Aug. 31, 1982

[54] METHOD OF MAKING ABSORBABLE SURGICAL SUTURES

[76] Inventors: Boris G. Yasnitsky, pereulok Rogatinsky, 56, kv. 1; Galina M. Tsukanova, prospekt Moskovsky, 198/2, kv. 66; Valentin A. Oridoroga, ulitsa Sotsialisticheskaya, 15, all of Kharkov; Jury A. Furmanov, prospekt Nauki, 142, korpus 12, kv. 4, Kiev, all of U.S.S.R.

[21] Appl. No.: 240,680

[22] Filed: Mar. 5, 1981

[51] Int. Cl.[3] ..... D06M 1/00; D06M 1/22

[52] U.S. Cl. ..... 8/116 R

[58] Field of Search ..... 8/116 R

[56] References Cited

U.S. PATENT DOCUMENTS

| | | | |
|---|---|---|---|
| 2,423,707 | 7/1947 | Kenyon et al. | 8/116 R |
| 2,448,892 | 9/1948 | Kenyon et al. | 8/116 R |
| 2,537,979 | 1/1951 | Eberl | 8/116 R |

*Primary Examiner*—Maria Parrish Tungol

*Attorney, Agent, or Firm*—Ladas & Parry

[57] ABSTRACT

A method of making absorbable surgical sutures consists in treating cellulose threads with nitrogen oxides in the medium of an organic solvent at a temperature of −11° to +21° C. for 10 to 30 min and withdrawing the cellulose threads from the organic solvent and subjecting them to thermal treatment at a temperature of +30° to +70° C. and at an excessive pressure for 15 min to 1.5 hours.

2 Claims, No Drawings

METHOD OF MAKING ABSORBABLE SURGICAL SUTURES

BACKGROUND OF THE INVENTION

Field of the Invention

The invention relates to a method of making absorbable surgical sutures and particularly to a method of making absorbable surgical sutures based on cellulose threads and can be used in medicine and veterinary science.

At present absorbable sutures are widely used in medical practice. They do not require such a manipulation as suture removal and provide for a proper cosmeticability of the cicatrices resulting from surgical operations.

In order to be successfully used, the absorbable sutures should possess a sufficient strength. However, conventional absorbable sutures are of inadequate mechanical strength. Therefore efforts are constantly undertaken to develop novel methods of making absorbable sutures based on cellulose which are characterized by a higher mechanical strength.

Known in the art is a method of making homeostatic preparations in the form of napkins (Jackel E. C., Kenyon W. R., J. Am. Chem. Soc., vol. 64, p. 121, 1942), consisting in oxidizing cellulose with nitrogen dioxide, the oxidation process being carried out till the content of carboxyls is from 16 to 24%.

Cellulose comprising from 16 to 24% of carboxyls is of a low mechanical strength and can not be used for making surgical sutures.

There is known in the art another method of making surgical sutures (U.S. Pat. No. 2,537,979) which consists in oxidizing cellulose with nitrogen dioxide. However, as distinct from the method described above, the oxidation here is carried out till the content of carboxyls is 4 to 12.5%. The time duration of making said surgical sutures is 64 hours. The process is carried out at a temperature of 25° C. Having been treated with nitrogen dioxide, the threads are washed with distilled water and dried. The ratio between the tensile strength of the sutures produced due to the treatment of the cellulose threads and the tensile strength of the cellulose threads prior to the treatment is 36.8 to 43.5%, i.e. the loss in strength is 56.5 to 63.2%. The low mechanical strength of the absorbable surgical sutures produced by the above method makes it difficult to carry out surgical manipulations.

In addition, the absorbable surgical sutures fabricated in accordance with U.S. Pat. No. 2,537,979 lost its strength, as mentioned in the Specification of the above Patent, within 5 days. The testing was carried out in a phosphate buffered solution having a pH of 7.5 at a temperature of 37° C. where a suture is absorbed slower than in living tissues. No testing of the suture placed in living tissues was carried out.

Thus, the above-described method takes too much time and does not provide for the manufacture of absorbable surgical sutures having a high mechanical strength.

SUMMARY OF THE INVENTION

The object of the present invention is to provide a method of making surgical sutures, which makes it possible to increase the quality of absorbable surgical sutures by improving their mechanical strength and at the same time to intensify the process.

This object is attained by that there is provided a method of making absorbable surgical sutures comprising treating cellulose threads with nitrogen oxides, wherein, according to the invention, the cellulose threads are treated with nitrogen oxides in the medium of an organic solvent at a temperature of −11° to +21° C. for 10 to 30 min, then withdrawn from the organic solvent and held at a temperature of +30° to +70° C. and at an excessive pressure for 15 min to 1.5 hours.

Twisted surgical threads based on cellulose fibres are usually made by way of twisting together a number of monothreads. Therefore the density of such threads is higher than their porosity. Because of this the inner layers of the thread are less accessible for nitrogen oxides than the outer layers, which is responsible for a non-uniform sorption of nitrogen oxides by inner and outer layers of the thread and, consequently, for different mechanical strength of the outer and inner layers.

As a result of treating cellulose threads with nitrogen oxides in the medium of an organic solvent these threads swell, which permits an even sorption of nitrogen oxides throughout the whole volume thereof. A rise in the temperature during the second stage of the process leads to evaporation of the organic solvent, desorption of a part of the oxides and a shift of the equilibrium $N_2O_4 \rightleftarrows 2NO_2$ to the right till equilibrium is attained. In this manner an excessive pressure is built up in the sealed vessel, which pressure promotes reverse processes, i.e. an increase in the sorption of the oxides, condensation of the solvent and a shift of the equilibrium $N_2O_4 \rightleftarrows 2NO_2$ to the left till equilibrium is attained. If these processes proceed at the above-mentioned parameters, the oxides distribute uniformly throughout the whole volume of the thread, thereby uniformly oxidizing all the fibers and speeding up the oxidation process.

It is expedient that the organic solvent be carbon tetrachloride, or trichlorofluoromethane, or 1,2,2-trifluoro-1,1,2-trichloroethane, or 1,2-dichloro-1,1,2,2-tetrafluoroethane and the threads be held at a temperature of +55° to +70° C. and at an excessive pressure of 506 hPa to 1519 hPa. Such a modification of the method is most suitable for the production purposes and ensures the highest rate of the process.

DETAILED DESCRIPTION OF THE INVENTION

Cellulose threads are placed into a reaction vessel made from stainless steel and having a capacity of 1 liter or 30 liters. The cellulose threads may be threads from cotton, flax, viscose, polynose etc which are characterized by a wide range of thickness and an amount of additions.

A preliminary prepared solution of nitrogen tetroxide in an organic solvent is poured into said reaction vessel whereto threads have been placed.

After filling up the reaction vessel with the solution of nitrogen tetroxide in an organic solvent the vessel is sealed, and the threads are held therein at a constant temperature which is within the range of from −11° to +21° C. for 10 to 30 min. Then the threads are withdrawn from said reaction vessel and placed into another empty reaction vessel of 0.2 liter capacity which is then sealed as well. The threads are held in this latter vessel for 15 min to 1.5 hours at a temperature of +30° to +70° C. and at an excessive pressure. When using carbon tetrachloride, or trichlorofluoromethane, or 1,2,2-trifluoro-1,1,2-trichloroethane, or 1,2-dichloro-1,1,2,2-tetrafluoroethane, it is most advisable that the threads be held at a temperature of from +55° to +70° C. and at an excessive pressure of from 506 hPa to 1519 hPa.

Then the reaction vessel is unsealed, and the threads are blown through with dry air therein for 15 to 30 min to remove the excess of nitrogen oxides and the solvent. Thereupon, the threads are washed and dried by conventional methods. For instance, the washing may be carried out with 50% propyl alcohol until pH of the washing liquid is not less than 3.2, and then with 100% propyl alcohol. The drying may be carried out with a stream of air having a temperature of 19° to 20° C.

Thus produced sutures were tested to determine the tensile strength thereof and the content of carboxyls therein. The testing was carried out in accordance with conventional procedures.

Now the invention will be explained by way of Examples thereof.

EXAMPLE 1

A method of making absorbable surgical sutures according to the invention was carried out in the following way.

10 grams of cotton threads having a size of 100/18 (diameter 0.56 ml) comprising a single strand with a nominal linear density of 10 tex were wound onto a stainless steel spool, placed into a reaction vessel having a capacity of 1 liter and poured with 250 ml of a 9% solution of nitrogen tetroxide in carbon tetrachloride. Then the reaction vessel was sealed and the threads contained therein were held at a temperature of +20° C. for 10 min. Thereupon, the spool with the threads was withdrawn from the solution and placed into an empty reaction vessel of 0.2 liters capacity, which vessel was then also sealed. The temperature in this reaction vessel was raised up to +40° C. Simultaneously therewith, the pressure in the reaction vessel increased up to 810 hPa.

After holding the threads under the above conditions for 25 min the pressure was reduced to normal. Without withdrawing the threads from this reaction vessel the former were blown through with dry air for 30 min and then washed and dried. The washing and drying were substantially similar to those described above.

Thus produced sutures were tested to determine the content of carboxyls therein and the tensile strength thereof. The tensile strength of the cotton threads before treatment was determined as well.

The results of the testing are given in Table 1.

EXAMPLE 2

The method of making absorbable surgical sutures according to the invention was carried out in the following way.

10 grams of cotton threads similar to those used in Example 1 were treated in a 9% solution of nitrogen tetroxide in 1,2,2-trifluoro-1,1,2-trichloroethane.

The conditions of the treatment were the following:

| | |
|---|---|
| amount of the 9% solution of nitrogen tetroxide in 1,2,2-trichloro-1,1,2-trichloroethane, ml | 250 |
| temperature, °C. | 15 |
| time of treatment, min | 15 |

Further, the threads were treated according to the procedure described in Example 1.

| | |
|---|---|
| The conditions of the treatment were the following: | |
| time of treatment, min | 25 |
| temperature, °C. | 50 |
| excessive pressure, hPa | 1013 |

Thus produced sutures were washed and dried in accordance with the procedure described above.

The results of the testing of the cellulose threads prior to the treatment and of the sutures produced due to the treatment of the cellulose threads are given in Table 1.

EXAMPLE 3

The method of making absorbable surgical sutures according to the invention was carried out in the following way.

20 grams of cotton threads similar to those used in Example 1 were treated with a 7.5% solution of nitrogen tetroxide in trichlorofluoromethane (Freon 11).

The conditions of the treatment were the following: amount of the 9% solution of nitrogen

| | |
|---|---|
| tetroxide in trichlorofluoromethane, ml | 600 |
| temperature, °C. | 0 |
| time of treatment, min | 25 |

Further, the threads were treated according to the procedure described in Example 1.

The conditions of the treatment were the following:

| | |
|---|---|
| time of treatment, min | 25 |
| temperature, °C. | 60 |
| excessive pressure, hPa | 1317 |

Thus produced sutures were washed and dried in accordance with the procedure described above.

The results of the testing of the cellulose threads prior to the treatment and of the sutures produced due to the treatment of the cellulose threads are given in Table 1.

EXAMPLE 4

The method of making absorbable surgical sutures according to the invention was carried out in the following way.

30 grams of cotton threads similar to those used in Example 1 were treated in a 15% solution of nitrogen tetroxide in trichlorofluoromethane (Freon 11).

The parameters of the treatment were the following: amount of the 15% solution of

| | |
|---|---|
| nitrogen tetroxide in trichlorofluoromethane, ml | 600 |
| temperature, °C. | −11 |
| time of treatment, min | 30 |

Further, the threads were treated according to the procedure described in Example 1.

The conditions of the treatment were the following:

| | |
|---|---|
| time of treatment, min | 25 |
| temperature, °C. | 70 |

-continued

| | |
|---|---|
| excessive pressure, hPa | 1519 |

Thus produced sutures were washed and dried in accordance with the procedure described above.

The results of the testing of the cotton threads prior to the treatment and of the sutures produced due to the treatment of these cotton threads are given in Table 1.

TABLE 1

| Parameters | Example 1 | Example 2 | Example 3 | Example 4 |
|---|---|---|---|---|
| (1) Content of carboxyls, % | 4.0 | 6.3 | 7.9 | 9.8 |
| (2) Tensile strength of the cotton thread prior to treatment, kg | 3.1 | 3.1 | 3.1 | 3.1 |
| (3) Tensile strength of the sature, kg | 2.43 | 2.37 | 2.32 | 2.26 |
| (4) Ratio between the strength of the suture obtained due to the treatment of the cotton thread and the strength of the cotton thread prior to the treatment, % | 79.0 | 76.5 | 74.8 | 73.0 |

EXAMPLE 5

The method of making absorbable surgical sutures according to the invention was carried out in the following way.

40 grams of flax threads having a size of 22.5/3 (diameter 0.57 ml) comprising a single strand with a nominal linear density of 44.4 tex were treated with a 12% solution of nitrogen tetroxide in 1,2,2,-trifluoro-1,1,2-trichloroethane (Freon 113).

The conditions of the treatment were the following: amount of the 12% solution of nitrogen

| | |
|---|---|
| tetroxide in 1,2,2-trifluoro-1,1,2-trichloroethane, ml | 800 |
| temperature, °C. | 15 |
| time of treatment, min | 15 |

Further, the threads were treated according to the procedure described in Example 1.

The conditions of the treatment were the following:

| | |
|---|---|
| time of treatment, min | 20 |
| temperature, °C. | 50 |
| excessive pressure, hPa | 1215 |

Thus produced sutures were washed and dried in accordance with the procedure described above.

The results of the testing of the flax threads prior to the treatment and of the sutures produced due to the treatment of these flax threads are given in Table 2.

EXAMPLE 6

The method of making absorbable surgical sutures according to the invention was carried out in the following way.

30 grams of viscose threads having a size of 60/9 (diameter 0.54 ml) comprising a single strand with a nominal linear density of 16.6 tex were treated with a 10% solution of nitrogen tetroxide in 1,2-dichloro-1,1,2,2-tetrafluoroethane (Freon 114).

The conditions of the treatment were the following:

| | |
|---|---|
| amount of the 10% solution of nitrogen tetroxide in 1,2-dichloro-1,1,2,2-tetrafluoroethane, ml | 750 |
| temperature, °C. | −10 |
| time of treatment, min | 20 |

Further, the threads were treated also according to the procedure described in Example 1.

The conditions of the treatment were the following:

| | |
|---|---|
| time of treatment, min | 30 |
| temperature, °C. | 40 |
| pressure, hPa | 810 |

The produced sutures were washed and dried in accordance with the procedure described above.

The results of the testing of the viscose threads prior to the treatment and of the sutures produced due to the treatment of these viscose threads are given in Table 2.

EXAMPLE 7

The method of making absorbable surgical sutures according to the invention was carried out in the following way.

25 grams of viscose threads having a size of 20/3 (diameter 0.53 mm) comprising a single strand with a nominal linear density of 50 tex were treated in accordance with the procedure described in Example 1 with a 15% solution of nitrogen tetroxide in carbon tetroxide.

The conditions of the treatment were the following: amount of the 15% solution of

| | |
|---|---|
| nitrogen tetroxide in carbon tetroxide, ml | 500 |
| temperature, °C. | 21 |
| time of treatment, min | 15 |

Further, the threads were again treated according to the procedure described in Example 1.

The conditions of the treatment were the following:

| | |
|---|---|
| time of treatment, min | 15 |
| temperature, °C. | 50 |
| excessive pressure, hPa | 912 |

Thus produced sutures were washed and dried in accordance with the procedure described above.

The results of the testing of the cotton threads prior to the treatment and of the sutures produced due to the treatment of the cotton threads are given in Table 2.

EXAMPLE 8

The method of making absorbable surgical sutures according to the invention was carried out in the following way.

30 grams of viscose threads similar to those used in Example 7 were treated in accordance with the procedure described in Example 1 with a 12% solution of nitrogen tetroxide in carbon tetroxide.

The conditions of the treatment were the following:

| | |
|---|---|
| amount of the 12% solution of nitrogen tetroxide in carbon tetroxide, ml | 750 |
| temperature, °C. | 21 |
| time of treatment, min | 15 |

Further, the threads were again treated according to the procedure described in Example 1.

| The conditions of the treatment were the following: | |
|---|---|
| time of treatment, min | 30 |
| temperature, °C. | 50 |
| excessive pressure, hPa | 1013 |

Thus produced sutures were washed and dried in accordance with the procedure described above.

The results of the testing of the viscose threads prior to the treatment and of the sutures produced due to the treatment of these viscose threads are given in Table 2.

EXAMPLE 9

The method of making absorbable surgical sutures according to the invention was carried out in the following way.

40 grams of viscose threads having a size of 20/6 (diameter 0.86 ml) comprising a single strand with a nominal linear density of 50 tex were treated in accordance with the procedure described in Example 1 with a 15% solution of nitrogen tetroxide in trichlorofluoromethane (Freon 11).

The conditions of the treatment were the following: amount of the 15% solution of nitrogen tetroxide in

| | |
|---|---|
| trichlorofluoromethane, ml | 800 |
| temperature, °C. | 17 |
| time of treatment, min | 15 |

Further, the threads were again treated according to the procedure described in Example 1.

The conditions of the treatment were the following:

| | |
|---|---|
| time of treatment, min | 15 |
| temperature, °C. | 50 |
| excessive pressure, hPa | 1418 |

Thus produced sutures were washed and dried in accordance with the procedure described above.

The results of testing are given in Table 2.

TABLE 2

| Parameters | Example 5 | Example 6 | Example 7 | Example 8 | Example 9 |
|---|---|---|---|---|---|
| (1) Content of carboxyls, % | 3.6 | 4.0 | 3.0 | 6.8 | 3.5 |
| (2) Tensile strength of the cellulose thread prior to the treatment, kg | 1.88 | 2.7 | 4.5 | 4.5 | 6.0 |
| (3) Tensile strength of the sature produced from the cellulose thread due to the treatment of the latter, kg | 1.41 | 2.16 | 3.54 | 3.2 | 4.8 |
| (4) Ratio between the strength of the suture and the cellulose thread, % | 75.0 | 80.1 | 77.7 | 71.1 | 80.0 |

EXAMPLE 10

The method of making absorbable surgical sutures according to the invention was carried out in the following way.

30 grams of viscose threads having a size of 60/2 (diameter 0.15 ml) comprising a single strand with a nominal linear density of 16.6 tex were treated in accordance with the procedure described in Example 1 with a 9% solution of nitrogen tetroxide in carbon tetrachloride.

The conditions of the treatment were the following:

| | |
|---|---|
| amount of the 9% solution of nitrogen tetroxide in carbon tetrachloride, ml | 750 |
| temperature, °C. | 20 |
| time of treatment, min | 10 |

Further, the threads were again treated according to the procedure described in Example 1.

The conditions of the treatment were the following:

| | |
|---|---|
| time of treatment, min | 75 |
| temperature, °C. | 30 |
| excessive pressure, hPa | 506 |

Thus produced sutures were washed and dried in accordance with the procedure described above.

The results of the testing of the viscose threads prior to the treatment and of the sutures produced due to the treatment of these viscose threads are given in Table 3.

EXAMPLE 11

The method of making absorbable surgical sutures according to the invention was carried out in the following way.

40 grams of polynose threads having a size of 60/6 (diameter 0.42 ml) comprising a single strand with a nominal linear density of 16.6 tex were treated in accordance with the procedure described in Example 1 with a 15% solution of nitrogen tetroxide in trichlorofluoromethane (Freon 11).

The conditions of the treatment were the following:

| | |
|---|---|
| amount of the 15% solution of nitrogen tetroxide in trichlorofluoromethane, ml | 800 |
| temperature, °C. | 10 |
| time of treatment, min | 20 |

Further, the threads were again treated according to the procedure described in Example 1.

The conditions of the treatment were the following:

| | |
|---|---|
| time of treatment, min | 60 |
| temperature, °C. | 40 |
| excessive pressure, hPa | 1519 |

Thus produced sutures were washed and dried in accordance with the procedure described above.

The results of the testing of the polynose threads prior to the treatment and of the sutures produced due to the treatment of these polynose threads are given in Table 3.

EXAMPLE 12

The method of making absorbable surgical sutures according to the invention was carried out in the following way.

30 grams of polynose threads having a size of 64/18 (diameter 0.86) comprising a single strand with a nominal linear density of 15.6 tex were treated in accordance with the procedure described in Example 1 with a 12% solution of nitrogen tetroxide in trichlorofluoromethane (Freon 11).

The conditions of the treatment were the following:

| | |
|---|---|
| amount of the 12% solution of nitrogen tetroxide in trichlorofluoromethane, ml | 750 |
| temperature, °C. | 10 |
| time of treatment, min | 20 |

Further, the threads were again treated according to the procedure described in Example 1.

The conditions of the treatment were the following:

| | |
|---|---|
| time of treatment, min | 90 |
| temperature, °C. | 40 |
| excessive pressure, hPa | 1418 |

Thus produced sutures were washed and dried in accordance with the procedure described above.

The results of the testing of the polynose threads prior to the treatment and of the sutures produced due to the treatment of these polynose threads are given in Table 3.

TABLE 3

| Parameters | Example 10 | Example 11 | Example 12 |
|---|---|---|---|
| Content of carboxyls, % | 3.5 | 6.5 | 8.7 |
| Tensile strength of the cellulose thread prior to the treatment, kg | 0.96 | 3.0 | 4.82 |
| Tensile strength of the sature produced from the cellulose thread due to the treatment of the latter, kg | 0.77 | 2.20 | 3.58 |
| Ratio between the strength of the suture and the strength of the cellulose thread, % | 79.8 | 73.3 | 74.2 |

EXAMPLE 13

The method of making absorbable surgical sutures according to the invention was carried out in the following way. 1.0 kg of polynose threads (10,000 m) having a size of 60/6 (diameter 0.42 mm) and comprising a single strand with a nominal linear density of 16.6 tex were wound into 10 balls and placed into a stainless steel apparatus of a 30 liters capacity. The apparatus was filled with 20 liters of a 15% solution of nitrogen tetroxide in trichlorofluoromethane (Freon 11) and held at a temperature of 10° for 20 min. Then the solution was discharged, the apparatus sealed, and the temperature within the apparatus raised up to 40° C. As this took place, an excessive pressure of 1519 hPa was produced within the apparatus which was held under such conditions for 60 min and then unsealed. Such being the case, the pressure within the apparatus reduced to normal. Then the threads were blown with dry air and washed and dried in accordance with the procedure described above.

Thus produced suture was tested to determine the content of carboxyls therein and the tensile strength thereof. The tensile strength of the polynose threads before treatment was determined as well.

Proceeding from the obtained data there was determined the loss of strength after treatment (the ratio between the tensile strength of the sutures produced according to the invention and the tensile strength of the polynose threads before treatment).

The obtained results were the following:

| | |
|---|---|
| suture produced according to the invention | |
| content of carboxyls, % | 6.5 |
| tensile strength, kg | 2.26 |
| cotton thread before treatment | |
| tensile strength, kg | 3.0 |
| ratio between the tensile strength of the sutures produced according to the invention and the tensile strength of the polynose threads before treatment, % | 63 |

Animals (rabbits, rams etc.) were subjected to median laparotomy under general anesthesia, whereupon 1.5 cm long through incisions were made in the tissue of their liver. Then interrupted sutures were applied to the incisions in the tissue. When suturing the abdominal wall, the sutures were applied alternately. The absorbable surgical suture did not present any difficulties for surgical manipulations with a non-absorbable suture.

The animals were killed at different terms after the operation.

The absorbable suture produced according to the invention lost its mechanical strength in the tissue in the course of 5±1 days. No inflammatory changes were noted.

While particular embodiments of the invention have been shown and described, various modifications thereof will be apparent to those skilled in the art and therefore it is not intended that the invention be limited to the disclosed embodiments or to the details thereof and the departures may be made therefrom within the spirit and the scope of the invention as defined in the claims.

What we claim is:

1. A method of making absorbable surgical sutures comprising treating cellulose threads with nitrogen dioxide in a solution of an organic solvent at a temperature of −11° to 21° C. for 10 to 30 minutes, withdrawing the cellulose threads from the organic solvent and holding them in a sealed chamber at a temperature of +30° to 70° C. for 15 minutes to 1.5 hours at a superatmospheric pressure of 506 hPa to 1519 hPa.

2. A method as claimed in claim 1, where said organic solvent is a perhalogenated hydrocarbon selected from the group consisting of carbon tetrachloride, trichlorofluoromethane, 1, 2, 2-trifluoro-1,1,2-trichloroethane and 1, 2-dichloro-1, 1, 2, 2-tetrafluoroethane, and the treatment in a sealed chamber is effected by holding at a temperature of +55° to +70° C.

* * * * *